US007465192B2

(12) United States Patent
McKenzie et al.

(10) Patent No.: US 7,465,192 B2
(45) Date of Patent: Dec. 16, 2008

(54) IN-LINE SEALED ELECTRICAL CONNECTOR APPARATUS

(75) Inventors: Jeffrey A. McKenzie, Milford, MI (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/518,186

(22) Filed: Sep. 11, 2006

(65) Prior Publication Data

US 2008/0064260 A1 Mar. 13, 2008

(51) Int. Cl.
*H01R 13/40* (2006.01)

(52) U.S. Cl. ..... 439/587; 439/275

(58) Field of Classification Search ..... 439/587, 439/588, 274, 275

See application file for complete search history.

(56) References Cited

U.S. PATENT DOCUMENTS

| | | | | |
|---|---|---|---|---|
| 5,240,440 | A | 8/1993 | Le Bris | |
| 5,836,788 | A * | 11/1998 | Torii | 439/587 |
| 6,176,727 | B1 | 1/2001 | Liu et al. | |
| 6,217,394 | B1 * | 4/2001 | Sugie | 439/752.5 |
| 6,332,800 | B2 | 12/2001 | Kodama | |
| 6,398,585 | B1 * | 6/2002 | Fukuda | 439/587 |
| 6,527,586 | B2 * | 3/2003 | Okamura et al. | 439/587 |
| 6,558,179 | B2 * | 5/2003 | Nakamura et al. | 439/275 |
| 6,609,932 | B2 * | 8/2003 | Fukatsu et al. | 439/588 |
| 6,692,301 | B2 * | 2/2004 | Okayasu et al. | 439/587 |
| 6,739,908 | B2 * | 5/2004 | Hamai et al. | 439/587 |
| 6,866,529 | B2 * | 3/2005 | Hobson et al. | 439/271 |
| 7,033,216 | B2 * | 4/2006 | Ito | 439/587 |
| 2002/0115345 | A1 * | 8/2002 | Nakamura et al. | 439/587 |

OTHER PUBLICATIONS

PCT/ISA/210, Int'l. App. No. PCT/US2007/018805, Mar. 19, 2008.

* cited by examiner

*Primary Examiner*—Tho D Ta
(74) *Attorney, Agent, or Firm*—Rader, Fishman & Grauer, PLLC

(57) ABSTRACT

An in-line sealed electrical connector apparatus includes a female connector assembly and a male connector assembly. The female connector assembly includes a female housing, a female wire seal and a female cover. The male connector assembly includes a male housing, a retention clip, a male housing seal defining a male housing seal opening, a male wire seal and a male cover. The retention clip formed in a generally U-shaped configuration to define a generally D-shaped retention clip duct extending longitudinally through the retention clip. The generally D-shaped retention clip duct is sized to slidably receive the female housing such that, upon engaging the female connector assembly and the male connector assembly, the female housing is first received through the generally D-shaped retention clip duct and is thereafter inserted through the male housing seal opening.

27 Claims, 9 Drawing Sheets

IN-LINE SEALED ELECTRICAL CONNECTOR APPARATUS

FIELD OF THE INVENTION

The present invention relates to an electrical connector. More particularly, the present invention is directed to an in-line sealed electrical connector.

BACKGROUND OF THE INVENTION

In-line sealed electrical connectors are known in the art. One in-line sealed electrical connector known in the art is described in U.S. Pat. No. 5,240,440. This electrical connector includes a front insulating body formed with a plurality of parallel passages formed with respective abutment shoulders and has a rear tubular skirt. Each one of a plurality of electrical contacts is positioned in each respective passage and is in abutment against the shoulder thereof. An electrically insulating plate is insertable into and within the skirt. The plate has catch fingers arranged for abutment against a rearwardly directed shoulder formed on each contact for locking the contact. The plate can be locked in abutment against the front insulating body. The passages in the front insulating body have such a shape that the passages prevent the catch fingers from spreading apart and that the passages maintain the catch fingers against the shoulders of the contacts when the plate is in abutment against the insulating plate. An intermediate adapter has a tubular section which is insertable from the rear onto the skirt of the front insulating body and has forwardly projecting resilient fastening fingers arranged for snapping into recesses of the front insulating body when the intermediate adapter is forced into complete insertion.

Another in-line sealed electrical connector is described in U.S. Pat. No. 6,332,800 as a connector assembly having inertia locking mechanism. The connector lock mechanism has a receptacle connector and a plug connector which are engaged with each other. The receptacle connector has a first lock portion and a first inertia locked portion. The plug connector has a second lock portion and a second inertia locked portion. The first lock portion is engaged with second lock portion. The first inertia locked portion is engaged with the second inertia locked portion. The first lock portion has a first locking piece and a push piece that moves the first locking piece. The first inertia locked portion has a lock arm provided with a second locking piece. The second lock portion has a third locking piece that engages with the first locking piece after abutment thereof or when the push piece is depressed. The second inertia locked portion has a fourth locking piece engaged with the second locking piece after a temporary resistance force against the mating of the connectors is produced.

In practice, these prior art in-line sealed electrical connectors might be too large to be used in certain applications such as in automobiles. For instance, for use in certain automobile applications, there are sometimes size-driven constraints that prevent the use of the prior art in-line sealed electrical connectors because of their relatively large size.

Also, in order to meet size-driven constraints, the in-line sealed electrical connector must be smaller. However, with smaller in-line sealed electrical connectors, sometimes it is difficult for a person connecting the mating parts to determine if the mating parts are oriented properly to assure proper connection of the mating electrical terminals.

It would be beneficial to provide a small in-line sealed electrical connector that can be used for applications with size-driven constraints.

It would also be beneficial to provide a small in-line sealed electrical connector in-line sealed electrical connector that can be used for applications with size-driven constraints and is designed to assure proper orientation of the mating parts for proper engagement of the mating electrical terminals. The present invention provides these benefits.

OBJECTS AND SUMMARY OF THE INVENTION

It is an object of the invention to provide a small in-line sealed electrical connector that can be used for applications with size-driven constraints.

It is another object of the invention to provide a small in-line sealed electrical connector that can be used for applications with size-driven constraints and is designed to assure proper orientation of the mating parts for proper engagement.

One embodiment of an in-line sealed electrical connector apparatus of the present invention includes a female connector assembly and a male connector assembly. The female connector assembly includes a female housing, a female wire seal and a female cover. The female housing extends along a longitudinal axis and is generally configured in cross-section in a generally D-shape to define a longitudinally-extending generally rectangularly-shaped female connector passageway. The female wire seal and the female cover are sized and adapted to be received by the female connector passageway in a close-fitting relationship.

The male connector assembly includes a male housing, a retention clip, a male housing seal defining a male housing seal opening, a male wire seal and a male cover. The male housing extends along the longitudinal axis to define a longitudinally-extending male connector passageway. The male housing has a female-receiving housing portion defining a female-receiving connector passageway portion of the male connector passageway and a sealed housing portion defining a seal-receiving connector passageway portion of the male connector passageway. The sealed housing portion and the female-receiving housing portion are integrally connected together. The female-receiving connector passageway portion is sized and adapted to receive the retention clip and the male housing seal in a close-fitting relationship and the seal-receiving connector passageway portion is sized and adapted to receive the male wire seal in a close-fitting relationship. The male cover is operative to cap the sealed male housing portion adjacent the male wire seal. The retention clip is formed in a generally U-shaped configuration to define a generally D-shaped retention clip duct extending longitudinally through the retention clip. The retention clip duct is sized to slidably receive the female housing such that, upon engaging the female connector and the male connector, the female housing is first received through the generally D-shaped retention clip duct and is thereafter inserted through the male housing seal opening.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
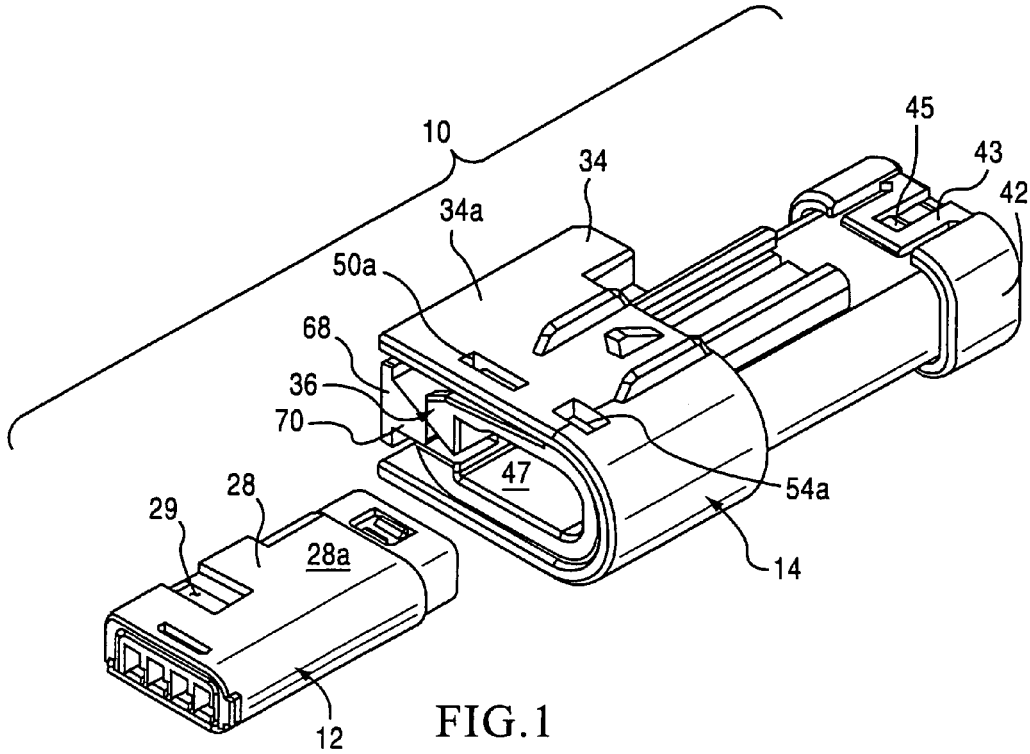
FIG. 1 is an exploded perspective view of an embodiment of an in-line sealed electrical connector apparatus of the present invention with a female connector assembly and a male connector assembly disengaged from one another.
Figure 2:
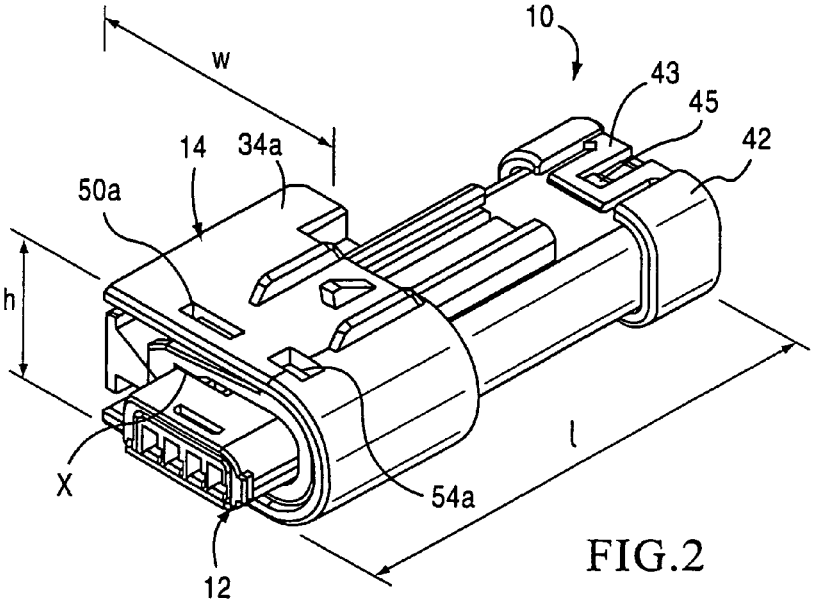
FIG. 2 is a perspective view of the in-line sealed electrical connector apparatus in FIG. 1 with the female connector assembly and the male connector assembly engaged with one another.
Figure 3:
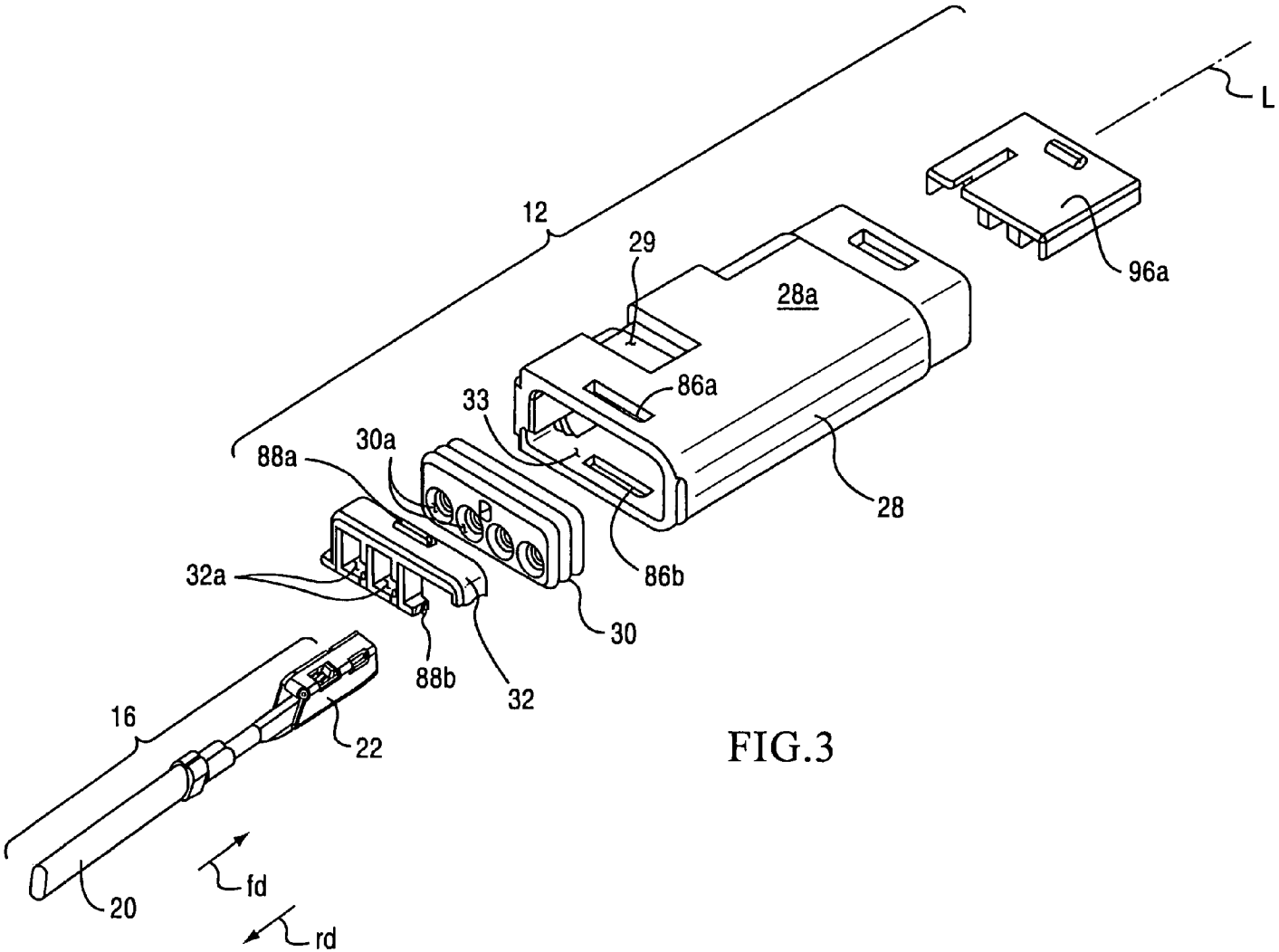
FIG. 3 is an exploded perspective view of the female connector assembly in FIGS. 1 and 2.
Figure 4:
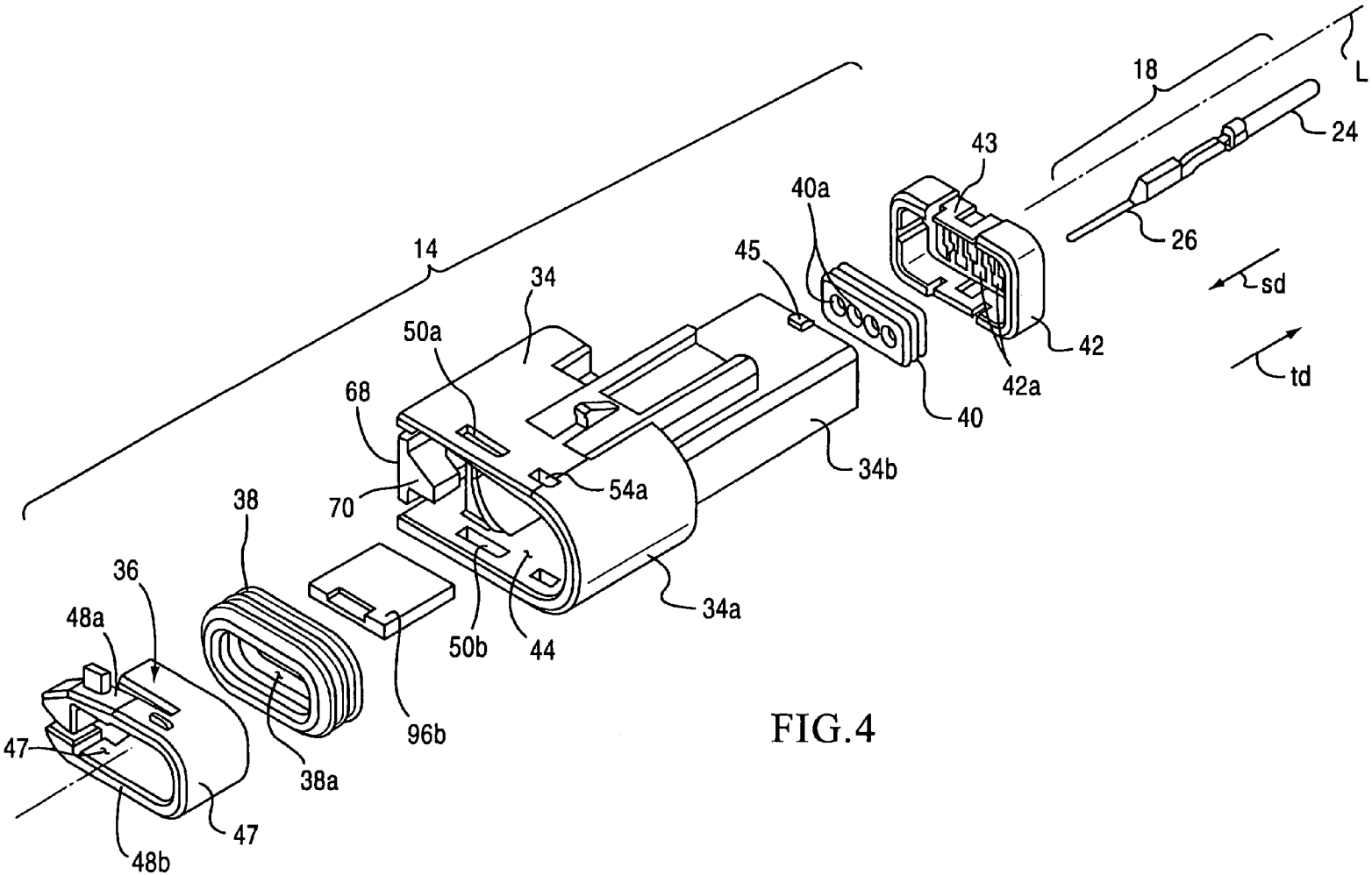
FIG. 4 is an exploded perspective view of the male connector assembly in FIGS. of 1 and 2.
Figure 5:
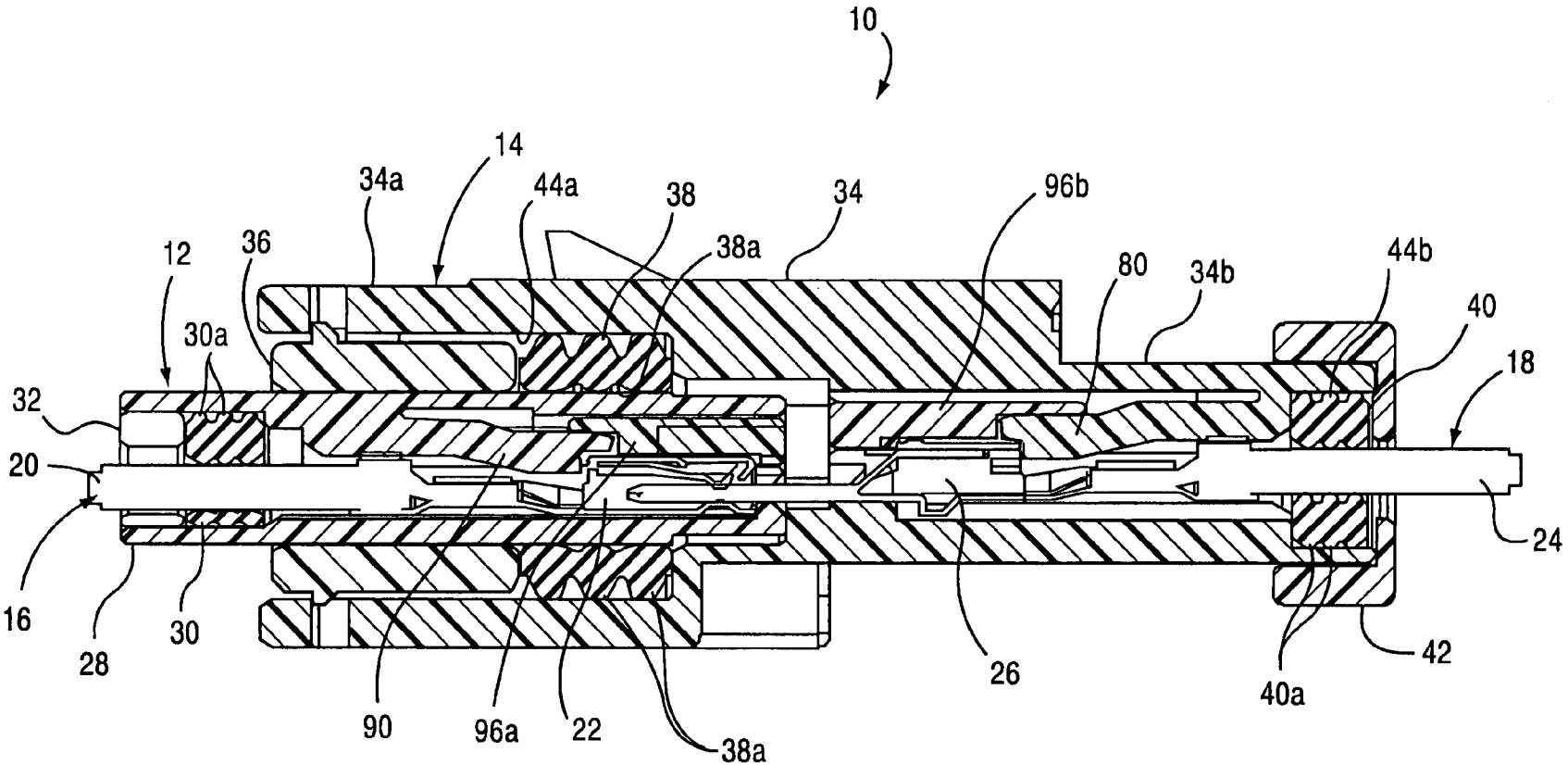
FIG. 5 is a cross-sectional view of the in-line sealed electrical connector apparatus in FIG. 2.

One exemplary embodiment of an in-line sealed electrical connector apparatus 10 of the present invention is hereinafter described with reference to FIGS. 1-12. As best shown in FIGS. 1 and 2, the in-line sealed electrical connector apparatus 10 of the present invention includes a female connector assembly 12 and a male connector assembly 14. As shown in FIGS. 3-5, the in-line sealed electrical connector apparatus 10 is adapted to facilitate connection of a first wire assembly 16 and a second wire assembly 18 in a sealed manner. The first wire assembly 16 has a first wire 20 electrically connected to a female terminal 22 and the second wire assembly 18 has a second wire 24 electrically connected to a male terminal 26. One of ordinary skill in the art would appreciate that the nomenclature used herein is appropriate because the female connector assembly 12 houses the female terminal 22 and the male connector assembly 14 houses the male terminal 26.

Figure 6:
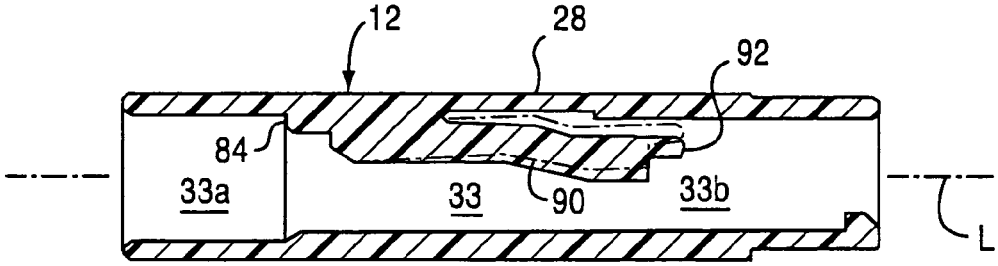
FIG. 6 is a cross-sectional view of a female housing of the female connector assembly in FIGS. 1 and 2.

As shown in FIG. 3, the female connector assembly 12 includes a female housing 28, a female wire seal 30 with a plurality of female wire seal holes 30*a* extending longitudinally there through and a female cover 32 with a plurality of female cover holes 32*a* extending longitudinally there through. The female housing 28 extends along a longitudinal axis L and is generally configured in cross-section in a D-shape to define a longitudinally-extending generally-rectangular female connector passageway 33 as best shown in FIGS. 3 and 6. In FIG. 5, the female wire seal 30 and the female cover 32 are sized and adapted to be received by the female connector passageway 33 in a close-fitting relationship.

Figure 7:
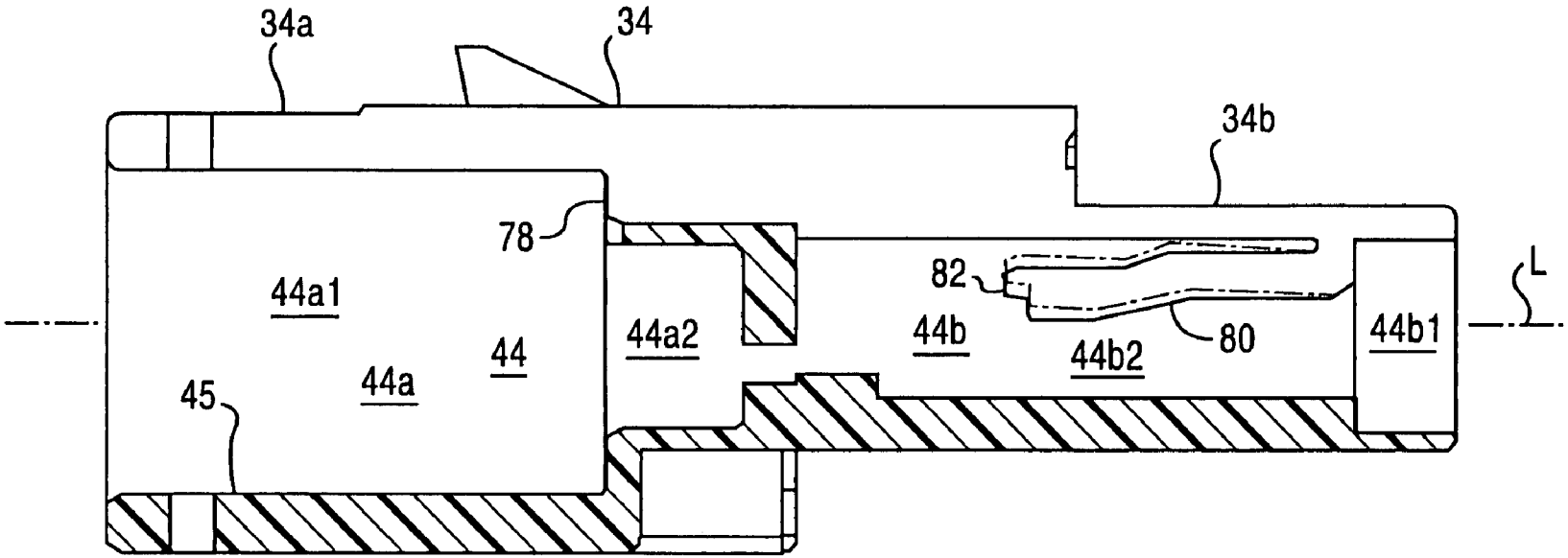
FIG. 7 is a cross-sectional view of a male housing of the male connector assembly in FIGS. of 1 and 2.

With reference to FIG. 4, the male connector assembly 14 includes a male housing 34, a retention clip 36, a male housing seal 38 defining a male housing seal opening 38*a*, a male wire seal 40 having at least one male wire seal hole 40*a* extending there through and a male cover 42 having at least one male cover hole 42*a* extending there through and in axial alignment with the at least one male wire seal hole 40*a*. As best shown in FIGS. 4 and 7, the male housing 34 extends along the longitudinal axis L to define a longitudinally-extending male connector passageway 44. The male housing 34 has a female-receiving housing portion 34*a* defining a female-receiving connector passageway portion 44*a* of the male connector passageway 44 and a sealed housing portion 34*b* defining a seal-receiving connector passageway portion 44*b* of the male connector passageway 44. The sealed housing portion 34*b* and in the female-receiving housing portion 34*a* are integrally connected together. The female-receiving connector passageway portion 44*a* sized and adapted to receive the retention clip 36 and the male housing seal 38 in a close-fitting relationship as best shown in FIG. 5.

Also, as best shown in FIG. 5, the seal-receiving connector passageway portion 44*b* is sized and adapted to receive the male wire seal 40 in a close-fitting relationship and the male cover 42 is operative to cap the sealed male housing portion 34*b* adjacent the male wire seal 40. As best illustrated in FIGS. 1, 2 and 4, the male cover 42 has a latch 43 integrally connected to the male cover 42 as a conventional living hinge. The latch 43 is operative to engage a lip element 45 such that when the male cover 42 caps the sealed male housing portion 34*b*, the latch 43 and the lip element 45 engage with each other thereby releasable locking the male cover 42 and the sealed male housing portion 34*b* together.

The retention clip 36 is formed in a generally U-shaped configuration to define a generally D-shaped retention clip duct 47 as illustrated in FIGS. 1, 4 10 and 11. The retention clip duct 47 extends longitudinally through the retention clip 36. The generally D-shaped retention clip duct 47 is sized to slidably receive the female housing 28 as shown sequentially in FIGS. 1 and 2. A skilled artisan would appreciate that, upon engaging the female connector assembly 12 and the male connector assembly 14, the female housing 28 is first received through the generally D-shaped retention clip duct 47 and is thereafter inserted through the male housing seal opening 38*a* as best shown in FIG. 5.

Figure 8:
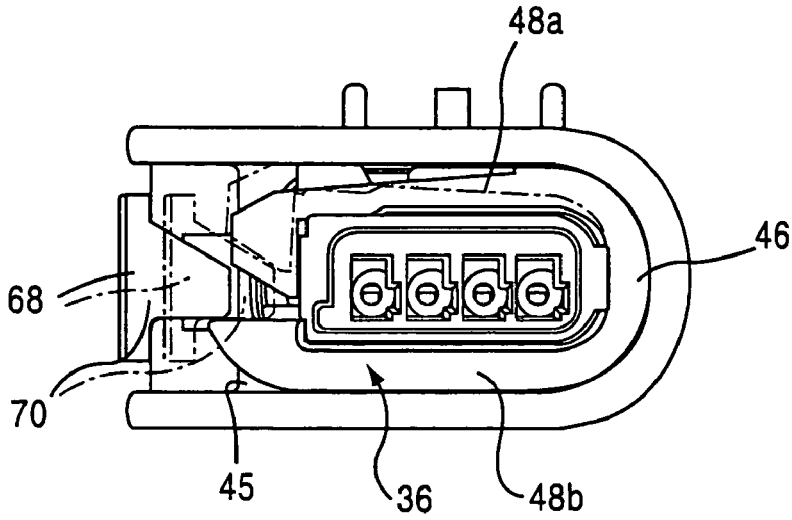
FIG. 8 is a front elevational view of the male connector assembly in FIGS. 1 and 2.
Figure 9:
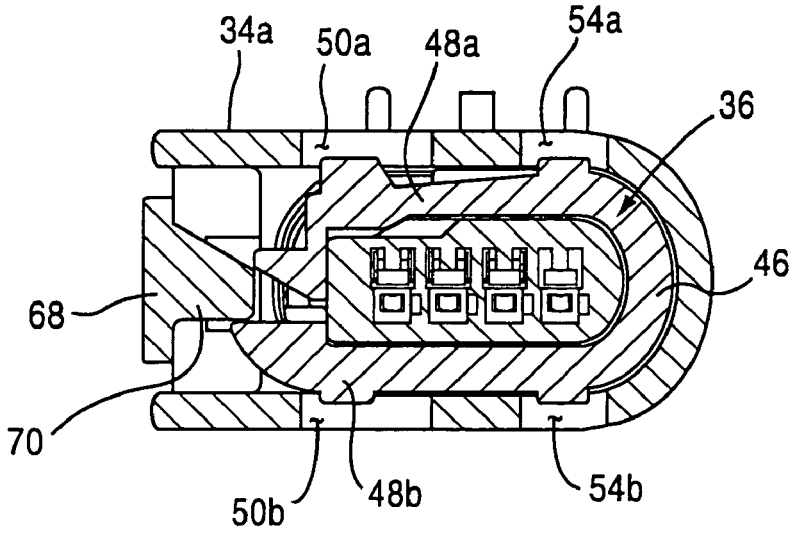
FIG. 9 is a front elevational view in cross-section of the male connector assembly in FIG. 8.

With reference to FIGS. 4, 8 and 9, the retention clip 36 includes an actuate piece 46 and a pair of arms 48*a* and 48*b*. The pair of arms 48*a* and 48*b* are disposed apart from one another and extend generally parallel with one another. The pair of arms 48*a* and 48*b* is integrally connected to the actuate piece 46 to form the generally U-shaped configuration which, as depicted in FIGS. 4, 8 and 9, is lying on one side. As the shown in FIGS. 10 and 11, the pair of arms 48*a* and 48*b* is operative to move to and between a neutral state illustrated in the solid line figures and a resiliently biased state illustrated in the dashed line figures. In the neutral state, the pair of arms 48*a* and 48*b* are disposed apart and extend generally parallel with one another and, in the resiliently biased state, the pair of arms 48*a* and 48*b* move in a pivoting manner towards (FIG. 11) or away (FIG. 10) from each other. However, when the retention clip 36 is received in the female-receiving connector passage way portion 44*a*, only one of the pair of arms 48*a* or 48*b*, which in this instance is arm 48*a*, moves in a pivoting manner towards or away from the remaining one of the pair of arms 48*b*. However, when moved away from the remaining arm 48*b*, the arm 48*a* is yet resiliently biased towards the neutral state.

Figure 10:
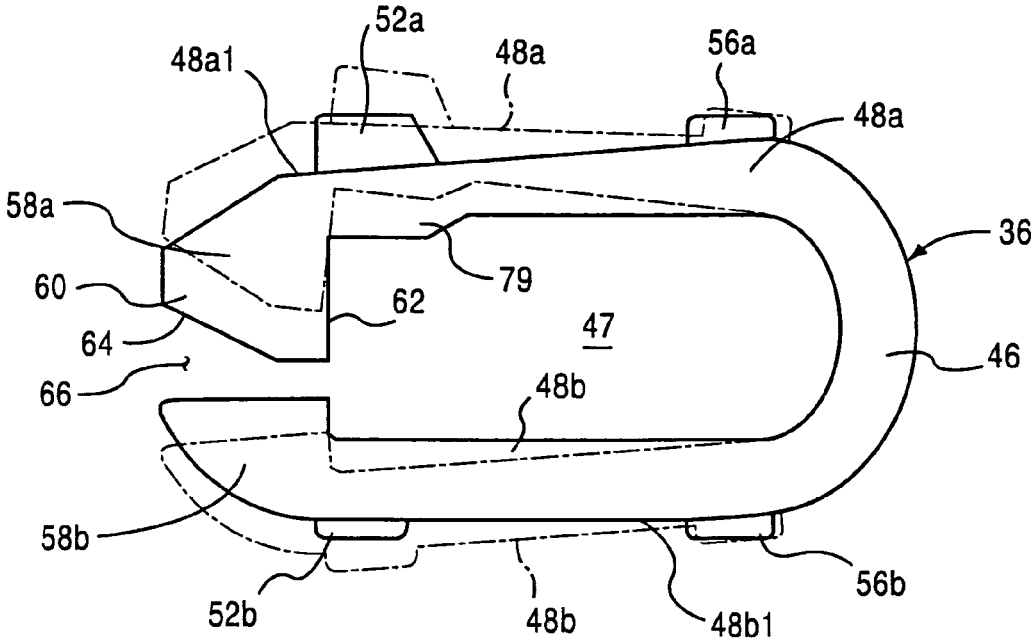
FIG. 10 is a side elevational view of a retention clip in a neutral state (solid lines) with its pair of arms disposed apart and extending generally parallel with one another and in a resiliently biased state (dashed lines) with its pair of arms pivoting away from each other and with the pair of arms being resiliently biased towards the neutral state.
Figure 11:
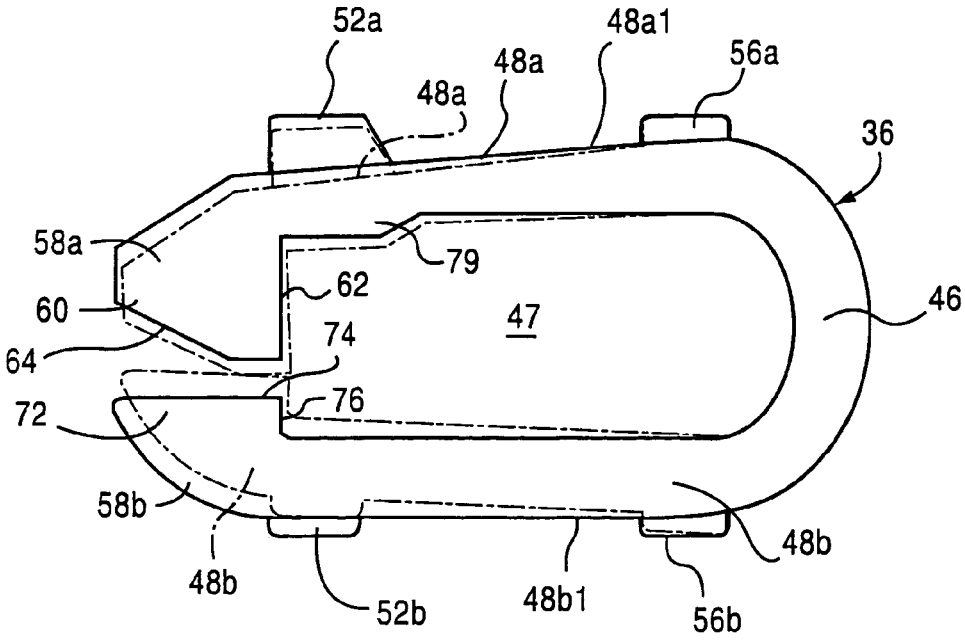
FIG. 11 is a side elevational view of the retention clip in its neutral state (solid lines) with its pair of arms disposed apart and extending generally parallel with one another and in the resiliently biased state (dashed lines) with its pair of arms pivoting towards each other and with the pair of arms being resiliently biased towards the neutral state.
Figure 12:
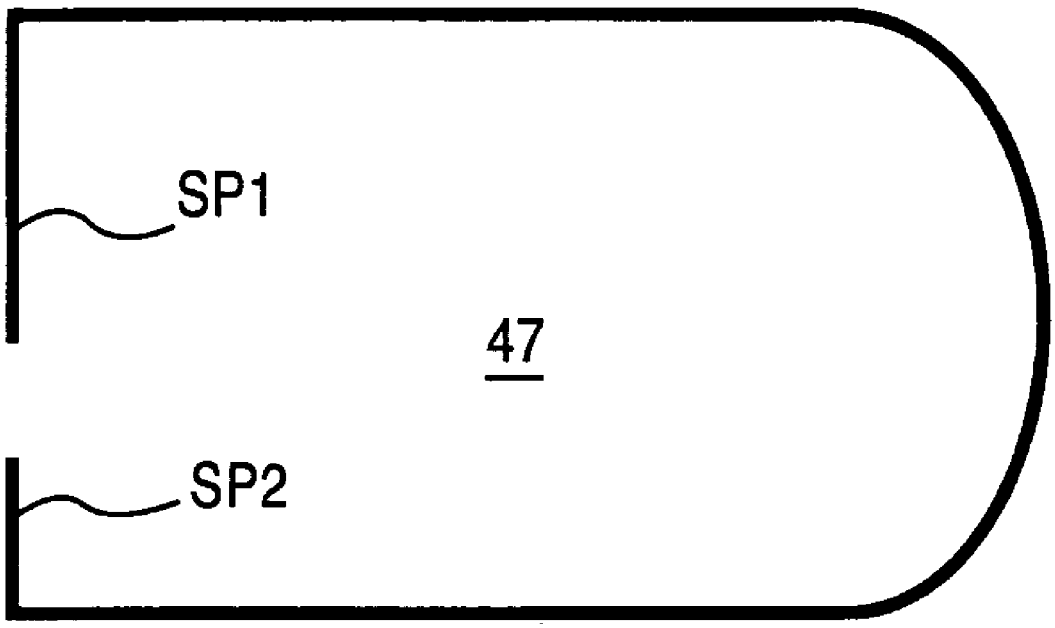
FIG. 12 is a diagrammatical view of a generally D-shaped retention clip duct that extends longitudinally through the retention clip.

In FIGS. 1, 2, 4 and 9, the female-receiving housing portion 34*a* of the male housing 24 has a first pair of facially opposing slots 50*a* and 50*b* formed there through. As best shown in FIGS. 10 and 11, each respective one of the pair of arms 48*a* and 48*b* has an outer arm surface 48*a*1 and 48*b*1 and a first projection 52*a* and 52*b* projecting from the respective outer arm surface 48*a*1 and 48*b*1. The first projections 52*a* and 52*b* are disposed in a manner that, when the retention clip 36 is received by the female-receiving connector passageway portion 44*a*, a respective one of the first and second projections 52*a* and 52*b* is received by a respective one of the first pair of facially opposing slots 50*a* and 50*b* thereby retaining the retention clip 36 in place within the female-receiving connector passageway portion 44*a*. Although not by way of limitation, the female-receiving housing portion 34*a* of the male housing 24 has a second pair of facially opposing slots 54*a* and 54*b* formed there through. As best shown in FIGS. 10 and 11, each respective one of the pair of arms 48*a* and 48*b* has a second projection 56*a* and 56*b* projecting from the respective outer arm surface 48*a*1 or 48*b*1. The second projections 56*a* and 56*b* are disposed in a manner that, when the retention clip 36 is received by the female-receiving connector passageway portion 44*a*, a respective one of the second projections 56*a* and 56*b* is received by a respective one of the pair of facially opposing slots 54*a* and 54*b* thereby also retaining the retention clip 36 in place within the female-receiving connector passageway portion 44*a*.

As best shown in FIGS. 10 and 11, each one of the pair of arms 48*a* and 48*b* has a free end portion 58*a* and 58*b* respectively. One of the free end portions, in this case free end portion 58*a*, includes a block member 60 integrally formed with the one free end portion 58*a*. The block member 60 has a first wall 62 facing the actuate piece when the retention clip is in the neutral state to define a first straight portion SP1 of the generally D-shaped retention clip duct 47 as illustrated in diagrammatic form in FIG. 12. The block member 60 has a second wall 62 that extends at an acute angle a relative to the first wall 62 in a manner to form a tapered opening 66. The tapered opening 66 tapers into the retention clip 36 such that the tapered opening 66 communicates with the generally D-shaped retention clip duct 47 at its narrowed end.

As shown in FIGS. 1, 4, 8 and 9, the male housing 34 includes a lever arm 68. In FIG. 8, the lever arm 68 has a wedge-shaped element 70. The lever arm 68 is movable to and between a neutral position as shown in the solid-line depiction and a retention clip spreading position as shown in the dashed-line depiction. In the neutral position, the wedge-shaped element 70 extends partially into the tapered opening 66 and, in the retention clip spreading position, the wedge-shaped element 70 extends into the tapered opening 66 while being in contact with the second wall 64 causing the free end portions 58*a* and 58*b* of the pair of arms 48*a* and 48*b* to spread apart from one another as shown by the dashed lines in FIG. 8. More specifically, the free end portion 58*b* will not separate much, if at all, because its movement is contained by a bottom wall portion 45 shown in FIGS. 7 and 8. Therefore, it would be appreciated by a skilled artisan that free end portion 58*a* is deflected. In the retention clip spreading position, disengagement of the female connector assembly 12 and the male connector assembly 14 is accommodated.

In FIGS. 10 and 11, a remaining one of the free end portions 58*b* includes a plateau member 72 integrally formed with the other one of the free end portions, i.e., free end portion 58*b*. The plateau member 72 has a flat plateau wall 74 that faces the block member 60 and a flat plateau side wall 76 extending perpendicularly to the flat plateau wall 74. The flat plateau side wall 76 faces the actuate piece 46 to define a second straight portion SP2 of the generally D-shaped retention clip duct 47 illustrated diagrammatically in FIG. 12.

Further, as shown in FIGS. 10 and 11, the retention clip 36 includes a retention clip latch 79 that extends into the generally D-shaped retention clip duct 47. As shown in FIGS. 1 and 3, the female housing 28 includes a retention clip latch-receiving notch 29 that is formed into an outer female housing surface 28*a*. The retention clip latch-receiving notch 29 is positioned represented by "X" in FIG. 2 in such a manner to releasably receive the retention clip latch 79 when the female connector assembly and the male connector assembly are connected together. A skilled artisan would appreciate that when the lever arm 68 is in the neutral position as shown in the solid-line depiction in FIG. 8, the retention clip latch 79 retains the female connector assembly 12 and the male connector assembly 14 connected together because the retention clip latch 79 is disposed in the retention clip latch-receiving notch 29. Further, a skilled artisan would appreciate that when the lever arm 68 is in the retention clip spreading position as shown in the dashed-line depiction in FIG. 8, the female connector assembly 12 and the male connector assembly 12 can be disconnected from one another because the retention clip latch 79 is removed from the retention clip latch-receiving notch 29.

With reference to FIG. 7, the female-receiving connector passageway portion 44*a* of the male housing 34 has an enlarged female-receiving connector passageway portion section 44*a*1 and a reduced female-receiving connector passageway portion section 44*a*2 with a stepped-down wall 78 separating the enlarged female-receiving connector passageway portion section 44*a*1 and the reduced female-receiving connector passageway portion section 44*a*2. The enlarged female-receiving connector passageway portion section 44*a*1 is sized to receive the retention clip 36 and the male housing seal 38 as best shown in FIG. 5. The male housing seal 38 is disposed between the retention clip 36 and the stepped-down wall 78 and, although not by way of limitation, abutting the stepped-down wall 78. The reduced female-receiving connector passageway portion section 44*a*2 receives a forward part of the female connector assembly 12, and, particularly a forward part of the female terminal 22.

Again, with reference to FIG. 7, the seal-receiving connector passageway portion 44*b* includes a seal-receiving connector passageway portion section 44*b*1 and a terminal locking arm-accommodating connector passageway portion section 44*b*2 that is in communication with the seal-receiving connector passageway portion section 44*b*1. Also, the male housing 34 includes a male housing terminal locking arm 80 that is connected to the male housing 34 in terminal locking arm-accommodating connector passageway portion section 44*b*2. The seal-receiving connector passageway portion section 44*b*1 is sized to receive the male wire seal 40 in a close-fitting relationship. The male housing terminal locking arm 80 is movable between a male terminal locking state depicted in solid lines and male terminal release state depicted in dashed lines in FIG. 7. A skilled artisan would appreciate that the male terminal locking arm 80 is resiliently biased to the male terminal locking state when the male terminal locking arm 80 is moved to the male terminal release state. For the exemplary embodiment of the present invention, the male terminal locking arm 80 has a male terminal locking arm notched free end 82.

In FIG. 6, the female connector passageway 33 of the female housing 28 of the female connector assembly 12 includes an enlarged female connector passageway section 33*a* and a reduced female connector passageway section 33*b*. A female connector stepped-down wall 84 is disposed between the enlarged female connector passageway section 33*a* and the reduced female connector passageway section 33*b*. The enlarged female connector passageway section 33*a* is sized to receive the female wire seal 30 and the female cover 32 as best shown in FIG. 5. The female wire seal 30 is disposed between the female connector stepped-down wall 84 and the female cover 32 and, although not by way of limitation, the female wire seal 30 abuts the female connector stepped-down wall 84.

In FIG. 3, the female housing 28 has a pair of facially opposing female housing slots 86*a* and 86*b* that are formed there through. The female cover 32 includes an opposing pair of latching projections 88*a* and 88*b*. The latching projections 88*a* and 88*b* are disposed on the female cover 32 in a manner such that, when the female cover 32 is received by the enlarged female connector passageway section 33*a*, a respective one of the latching projections 88*a* and 88*b* is received by a respective one of the pair of the facially opposing female housing slots 86*a* and 86*b* thereby retaining the female cover 32 in place within the enlarged female connector passageway section 33*a* of the female housing 28.

Further, as best shown in FIGS. 5 and 6, the female housing 28 includes a female housing terminal locking arm 90 that is connected to the female housing 28 in the reduced female connector passageway section 33*b*. The female housing terminal locking arm 90 is movable between a female terminal locking state shown in solid lines in FIG. 6 and female terminal release state shown in dashed lines in FIG. 6. The female terminal housing terminal locking arm 90 is resiliently biased to the female terminal lock state when moved to the female terminal release state. Although not by way of limitation, the female housing terminal locking arm 90 has a female housing terminal locking arm notched free end 92 shown in FIG. 6.

By way of example only and not by way of limitation, each one of female wire seal 30, the male housing seal 38 and the male wire seal 40 is fabricated from a sealing material such as rubber and each one has a plurality of circumferentially extending ribs 30*a*, 38*a* and 40*a* respectively as viewed in cross-section in FIG. 5. A skilled artisan would appreciate that the ribs 30*a*, 38*a* and 40*a* are shown by way of example only in cross-section in FIG. 5 as projecting outwardly and inwardly although alternative ribs might project only outwardly or only inwardly or perhaps have no ribs whatsoever.

It would be understood by one of ordinary skill in the art how the in-line sealed electrical connector apparatus 10 of the present invention is assembled and operates. The first wire assembly 16 is inserted in a first wire assembly insertion direction fd in FIG. 3 into the female connector assembly 12 such that the first wire 20 extends through the female cover hole 32*a* of the female cover and the female wire seal hole 30*a* of the female wire seal 30 with the female wire seal 30 gripping the first wire 20 in a sealing manner. As the female terminal 22 is being inserted into the female housing 28, the female terminal 22 first moves the female housing terminal locking arm 90 (see FIG. 6) from the female terminal locking state to the female terminal release state and then permits the female housing terminal locking arm 90 to move back into the female terminal locking state (see FIG. 5) to prevent removal of the female terminal 22 in a first wire assembly removal direction rd in FIG. 3 which is opposite the first wire assembly insertion direction fd.

The second wire assembly 18 is inserted in a second wire assembly insertion direction sd in FIG. 4 into the male connector assembly 14 such that the second wire 24 extends through the one male cover hole 42*a* of the male cover 42 and the one male wire seal hole 40*a* of the male wire seal 40 with the one male wire seal 40 gripping the second wire 24 in a sealing manner. As the male terminal 26 is being inserted into the male housing 34, the male terminal 26 first moves the male housing terminal locking arm 80 (see FIG. 7) from the male terminal locking state to the male terminal release state and then permits the male housing terminal locking arm 80 to move back into the male terminal locking state to prevent removal of the male terminal 26 in a second wire assembly removal direction td (see FIG. 4) being opposite the second wire assembly insertion direction sd.

Upon engaging the female connector assembly 12 and the male connector assembly 14, the female housing 28 is first received through the generally D-shaped retention clip duct 47 and is thereafter inserted through the male housing seal opening 38*a* such that the retention clip 36 substantially surrounds and grips the female housing 28 and the male housing seal 38 surrounds and grips the female housing 28 while a forward male terminal part of the male terminal 26 is slidably received by a forward female terminal part of the female terminal 22. As is known in the art, the terminal position assurance elements 96*a* and 96*b* are assembled into their final positions prior to the assembly of the female and male connector assemblies 12 and 14 respectively.

Furthermore, as is known in the art, a terminal position assurance element 96*a* might also be incorporated into the female connector assembly 12 (FIGS. 3 and 5) and a terminal position assurance element 96*b* might also be incorporated into the male connector assembly 14 (FIGS. 4 and 5) to assure that the respective first and second wire assemblies 16 and 18 cannot be easily removed once the female and male connector assemblies 12 and 14 respectively are engaged.

With reference to FIG. 2, the in-line sealed electrical connector apparatus 10 of the present invention in its engaged condition has a height h, a width w and a length. By way of example only, one embodiment of the present invention, in practice, has the height h of 6 mm, the width of 15 mm and the length of 28 mm. Thus, in-line sealed electrical connector apparatus is small and it can be used for many applications with size-driven constraints. Also, the in-line sealed electrical connector apparatus is designed to assure proper orientation of the female and male connector assemblies as a result of the D-shaped female housing being inserted in its proper orientation into the retention clip having a D-shaped retention clip duct sized to receive the D-shaped female housing.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An in-line sealed electrical connector apparatus, comprising:

a female connector assembly including a female housing, a female wire seal and a female cover, the female housing extending along a longitudinal axis and generally configured in cross-section in a generally D-shape to define a longitudinally-extending generally rectangularly-shaped female connector passageway, the female wire seal and the female cover sized and adapted to be received by the female connector passageway in a close-fitting relationship; and a male connector assembly including a male housing, a retention clip; a male housing seal defining a male housing seal opening, a male wire seal and a male cover, the male housing extending along the longitudinal axis to define a longitudinally-extending male connector passageway, the male housing having a female-receiving housing portion defining a female-receiving connector passageway portion of the male connector passageway and a sealed housing portion defining a seal-receiving connector passageway portion of the male connector passageway, the female-receiving housing portion and the sealed housing portion being integrally connected to each other, the female-receiving connector passageway portion sized and adapted to receive the retention clip and the male housing seal in a close-fitting relationship, the seal-receiving connector passageway portion sized and adapted to receive the male wire seal in a close-fitting relationship, the male cover operative to cap the sealed male housing portion adjacent the male wire seal, the retention clip formed in a generally U-shaped configuration to define a generally D-shaped retention clip duct extending longitudinally through the retention clip, the generally D-shaped retention clip duct sized to slidably receive the female housing such that, upon engaging the female connector assembly and the male connector assembly, the female housing is first received through the generally D-shaped retention clip duct and is thereafter inserted through the male housing seal opening.

2. An in-line sealed electrical connector apparatus according to claim 1, wherein the retention clip includes a retention clip latch extending into the generally D-shaped retention clip duct and the female housing includes a retention clip latch-receiving notch formed into an outer female housing surface and positioned to releasably receive the retention clip latch when the female connector assembly and the male connector assembly are connected together.

3. An in-line sealed electrical connector apparatus according to claim 1, wherein the female-receiving connector passageway portion of the male connector passageway has an enlarged female-receiving connector passageway portion section and a reduced female-receiving connector passageway portion section with a stepped-down wall separating the enlarged female-receiving connector passageway portion section and the reduced female-receiving connector passageway portion section, the enlarged female-receiving connector passageway portion section sized to receive the retention clip and the male housing seal with the male housing seal disposed between the retention clip and the stepped-down wall and abutting the stepped-down wall, the reduced female-receiving connector passageway portion section receiving a forward part of the female connector assembly.

4. An in-line sealed electrical connector apparatus according to claim 1, wherein each one of female wire seal, the male housing seal and the male wire seal is fabricated from a sealing material and has a plurality of outwardly extending ribs as viewed in cross-section.

5. An in-line sealed electrical connector apparatus according to claim 1, wherein the retention clip includes an arcuate piece and a pair of arms disposed apart from and extending generally parallel with one another and integrally connected to the arcuate piece to form the generally U-shaped configuration, the pair of arms operative to move to and between a neutral state and a resiliently biased state such that, in the neutral state, the pair of arms are disposed apart and extend generally parallel with one another and, in the resiliently biased state, at least one of the pair of arms moves in a pivoting manner towards or away from a remaining one of the pair of arms and yet is resiliently biased towards the neutral state.

6. An in-line sealed electrical connector apparatus according to claim 5, wherein the female-receiving housing portion of the male housing has a pair of facially opposing slots formed therethrough and each respective one of the pair of arms has an outer arm surface and a projection projecting from the outer arm surface, the projections being disposed in a manner that, when the retention clip is received by the female-receiving connector passageway portion, a respective one of the projections is received by a respective one of the pair of facially opposing slots thereby retaining the retention clip in place within the female-receiving connector passageway portion.

7. An in-line sealed electrical connector apparatus according to claim 5, wherein each one of the pair of arms has a free end portion, one of the free end portions includes a block member integrally formed with the one free end portion, the block member having a first wall facing the arcuate piece to define a first straight portion of the generally D-shaped retention clip duct.

8. An in-line sealed electrical connector apparatus according to claim 7, wherein a remaining one of the free end portions includes a plateau member integrally formed with the other one of the free end portions, the plateau member having a flat plateau wall facing the block member and a flat plateau side wall extending perpendicularly to the flat plateau wall, the flat plateau side wall facing the arcuate piece to define a second straight portion of the generally D-shaped retention clip duct.

9. An in-line sealed electrical connector apparatus according to claim 7, wherein the block member has a second wall that extends at an acute angle relative to the first wall in a manner to form a tapered opening tapering into the retention clip, the tapered opening communicating with the generally D-shaped retention clip duct at a narrowed end.

10. An in-line sealed electrical connector apparatus according to claim 9, wherein the male housing includes a lever arm having a wedge-shaped element and being movable to and between a neutral position and a retention clip spreading position such that, in the neutral position, the wedge-shaped element extends partially into the tapered opening and, in the retention clip spreading position, the wedge-shaped element extends into the tapered opening while in contact with the second wall causing the free end portions of the pair of arms to spread apart from one another thereby accommodating disengagement of the female connector assembly and the male connector assembly.

11. An in-line sealed electrical connector apparatus according to claim 1, wherein the seal-receiving connector passageway portion of the male connector passageway includes a seal-receiving connector passageway portion section and a terminal locking arm-accommodating connector passageway portion section in communication with the seal-receiving connector passageway portion section, the male housing including a male housing terminal locking arm connected to the male housing in terminal locking arm-accommodating connector passageway portion section, the male housing terminal locking arm movable between a male terminal locking state and male terminal release state, the male terminal locking arm being resiliently biased to the male terminal lock state when moved to the male terminal release state, the seal-receiving connector passageway portion section sized to receive the male wire seal in a close-fitting relationship.

12. An in-line sealed electrical connector apparatus according to claim 11, wherein the male terminal locking arm has a male terminal locking arm notched free end.

13. An in-line sealed electrical connector apparatus according to claim 1, wherein the female connector passageway includes an enlarged female connector passageway section and a reduced female connector passageway section with a female connector stepped-down wall disposed between the enlarged female connector passageway section and the reduced female connector passageway section, the enlarged female connector passageway section sized to receive the female wire seal and the female cover with the female wire seal disposed between the female connector stepped-down wall and the female cover with the female wire seal abutting the female connector stepped-down wall.

14. An in-line sealed electrical connector apparatus according to claim 13, wherein the female housing has a pair of facially opposing female housing slots formed therethrough and the female cover includes a pair of latching projections, the latching projections being disposed in a manner that, when the female cover is received by the enlarged female connector passageway section, a respective one of the latching projections is received by a respective one of the pair of facially opposing female housing slots thereby retaining the female cover in place within the enlarged female connector passageway section.

15. An in-line sealed electrical connector apparatus according to claim 14, wherein the female housing includes a female housing terminal locking arm connected to the female housing in the reduced female connector passageway section, the female housing terminal locking arm movable between a female terminal locking state and female terminal release state, the female terminal locking arm being resiliently biased to the female terminal lock state when moved to the female terminal release state.

16. An in-line sealed electrical connector apparatus according to claim 15, wherein the female housing terminal locking arm has a female housing terminal locking arm notched free end.

17. A retention clip device, comprising:

a body member having an arcuate piece and a pair of arms disposed apart from and extending generally parallel with one another and integrally connected to the arcuate piece to form the generally U-shaped configuration, the pair of arms operative to move to and between a neutral state and a resiliently biased state such that, in the neutral state, the pair of arms are disposed apart and extend generally parallel with one another and, in the resiliently biased state, at least one of the pair of arms moves in a pivoting manner towards or away from a remaining one of the pair of arms and yet is resiliently biased towards the neutral state, each one of the a pair of arms having an inner arm surface, an outer arm surface, a projection projecting from the outer arm surface and a free end portion, wherein one of the free end portions includes a block member integrally formed with the one free end portion and disposed internally of the retention clip, the block member having a first wall facing the arcuate piece to provide a first straight portion of a generally D-shaped retention clip duct defined at least in part by the first straight portion, the arcuate portion and the inner arm surfaces.

18. A retention clip device according to claim 17, wherein the block member has a second wall that extends at an acute angle relative to the first wall in a manner to form a tapered opening into the retention clip, the tapered opening narrowing to communicate with the generally D-shaped retention clip duct.

19. A retention clip device according to claim 18, wherein a remaining one of the free end portions includes a plateau member integrally formed with the remaining one of the free end portions and disposed internally of the retention clip, the plateau portion having a flat plateau wall facing the block member and a flat plateau side wall extending perpendicularly to the flat plateau wall, the flat plateau side wall facing the arcuate piece to provide a second straight portion of the generally D-shaped retention clip duct.

20. A female connector assembly, comprising:

a female housing;

a female wire seal; and a female cover, wherein the female housing extends along a longitudinal axis and is generally configured in cross-section in a generally D-shape to define a longitudinally-extending generally rectangularly-shaped female connector passageway and the female wire seal and the female cover is sized and adapted to be received by the female connector passageway in a close-fitting relationship, wherein the female connector passageway includes an enlarged female connector passageway section and a reduced female connector passageway section with a female connector stepped-down wall disposed between the enlarged female connector passageway section and the reduced female connector passageway section, the enlarged female connector passageway section is sized to receive the female wire seal and the female cover with the female wire seal disposed between the female connector stepped-down wall and the female cover and with the female wire seal abutting the female connector stepped-down wall, wherein the female housing includes a female housing terminal locking arm connected to the female housing in the reduced female connector passageway section, the female housing terminal locking arm is movable between a female terminal locking state and female terminal release state, the female terminal locking arm is resiliently biased to the female terminal lock state when moved to the female terminal release state, wherein the female housing terminal locking arm has a female housing terminal locking arm notched free end, and wherein the female housing terminal locking arm, connected to the female housing in the reduced female connector passageway section, extends longitudinally away from the enlarged female connector passageway section and terminates in the female housing terminal locking arm notched free end within the reduced female connector passageway section.

21. A female connector assembly according to claim 20, wherein the female housing has a pair of facially opposing female housing slots formed therethrough and the female cover includes a pair of latching projections, the latching projections being disposed in a manner that, when the female cover is received by the enlarged female connector passageway section, a respective one of the latching projections is received by a respective one of the pair of facially opposing female housing slots thereby retaining the female cover in place within the enlarged female connector passageway section.

22. A male connector assembly, comprising:

a male housing;

a retention clip;

a male housing seal defining a generally D-shaped male housing seal opening;

a male wire seal; and a male cover, wherein the male housing extends along a longitudinal axis to define a longitudinally-extending male connector passageway, the male housing having a female-receiving housing portion defining a female-receiving connector passageway portion of the male connector passageway and a sealed housing portion defining a seal-receiving connector passageway portion of the male connector passageway, the sealed housing portion integrally connected to the female-receiving housing portion, the female-receiving connector passageway portion sized and adapted to receive the retention clip and the male housing seal in a close-fitting relationship, the seal-receiving connector passageway portion sized and adapted to receive the male wire seal in a close-fitting relationship, the male cover operative to cap the sealed male housing portion adjacent the male wire seal, the retention clip formed in a generally U-shaped configuration to define a generally D-shaped retention clip duct extending longitudinally through the retention clip.

23. A male connector assembly according to claim 22, wherein the female-receiving housing portion of the male housing has a pair of facially opposing slots formed therethrough.

24. A male connector assembly according to claim 22, wherein the male housing includes a lever arm having a wedge-shaped element and being movable to and between a neutral position and a retention clip spreading position.

25. A male connector assembly according to claim 22, wherein the female-receiving connector passageway portion of the male housing has an enlarged female-receiving connector passageway portion section and a reduced female-receiving connector passageway portion section with a stepped-down wall separating the enlarged female-receiving connector passageway portion section and the reduced female-receiving connector passageway portion section, the enlarged female-receiving connector passageway portion section sized to receive the male housing clip and the male housing seal with the male housing seal disposed between the retention clip and the stepped-down wall and abutting the stepped-down wall.

26. A male connector assembly according to claim 22, wherein the seal-receiving connector passageway portion has an enlarged seal-receiving connector passageway portion section and a reduced seal-receiving connector passageway portion section with a male connector stepped-up wall separating the enlarged seal-receiving connector passageway portion section and the reduced seal-receiving connector passageway portion section, the enlarged seal-receiving connector passageway portion section sized to receive the male wire seal with the male wire seal abutting the male connector stepped-up wall and disposed between the male connector stepped-up wall and the male cover.

27. An in-line sealed electrical connector apparatus adapted to facilitate connection of a first wire assembly and a second wire assembly in a sealed manner, the first wire assembly having a first wire electrically connected to a female terminal and the second wire assembly having a second wire electrically connected to a male terminal, the in-line sealed electrical connector apparatus comprising:

a female connector assembly including a female housing, a female wire seal having at least one female wire seal hole extending therethough, a female cover having at least one female cover hole extending therethrough and in axial alignment with the at least one female wire seal hole and a female terminal locking arm, the female housing extending along a longitudinal axis and generally configured in cross-section in a generally D-shape to define a longitudinally-extending generally rectangularly-shaped female connector passageway, the female wire seal and the female cover sized and adapted to be received by the female connector passageway in a close-fitting relationship, the female housing terminal locking arm movable between a female terminal locking state and female terminal release state, the female terminal locking arm being resiliently biased to the female terminal lock state when moved to the female terminal release state; and a male connector assembly including a male housing, a retention clip, a male housing seal defining a male housing seal opening, a male wire seal having at least one male wire seal hole extending therethrough and a male cover having at least one male cover hole extending therethrough and in axial alignment with the at least one male cover hole, the male housing extending along the longitudinal axis to define a longitudinally-extending male connector passageway, the male housing having a female-receiving housing portion defining a female-receiving connector passageway portion of the male connector passageway and a sealed housing portion defining a seal-receiving connector passageway portion of the male connector passageway and integrally connected to the female-receiving housing portion, the female-receiving connector passageway portion sized and adapted to receive the retention clip and the male housing seal in a close-fitting relationship, the seal-receiving connector passageway portion sized and adapted to receive the male wire seal in a close-fitting relationship, the male cover operative to cap the sealed male housing portion adjacent the male wire seal, the retention clip formed in a generally U-shaped configuration to define a generally D-shaped retention clip duct extending longitudinally through the retention clip, the retention clip duct sized to slidably receive the female housing, wherein the first wire assembly is inserted in a first wire assembly insertion direction into the female connector assembly such that the first wire extends through the at least one female cover hole of the female cover and the at least one female wire seal of the female wire seal with the at least one female wire seal gripping the first wire in a sealing manner and, as the female terminal is being inserted into the female housing, the female terminal first moves the female housing terminal locking arm from the female terminal locking state to the female terminal release state and then permits the female housing terminal locking arm to move back into the female terminal locking. state to prevent removal of the female terminal in a first wire assembly removal direction being opposite the first wire assembly insertion direction, wherein the second wire assembly is inserted in a second wire assembly insertion direction into the male connector assembly such that the second wire extends through the at least one male cover hole of the male cover and the at least one male wire seal hole of the male wire seal with the at least one male wire seal gripping the second wire in a sealing manner and, as the male terminal is being inserted into the male housing, the male terminal first moves the male housing terminal locking arm from the male terminal locking state to the male terminal release state and then permits the male housing terminal locking arm to move back into the male terminal locking state to prevent removal of the male terminal in a second wire assembly removal direction being opposite the second wire assembly insertion direction, and wherein, upon engaging the female connector assembly and the male connector assembly, the female housing is first received through the generally D-shaped retention clip duct and is thereafter inserted through the male housing seal opening such that the retention clip substantially surrounds and grips the female housing and the male housing seal surrounds and grips the female housing while a forward male terminal part of the male terminal is slidably received by a forward female terminal part of the female terminal.

* * * * *